US012578097B1

(12) United States Patent
Suenaga et al.

(10) Patent No.: US 12,578,097 B1
(45) Date of Patent: Mar. 17, 2026

(54) HEATING COOKER

(71) Applicant: SHARP KABUSHIKI KAISHA, Sakai City (JP)

(72) Inventors: Hiromi Suenaga, Sakai City (JP); Nobuo Takemoto, Sakai City (JP); Kenji Kimura, Sakai City (JP)

(73) Assignee: SHARP KABUSHIKI KAISHA, Sakai City (JP)

( * ) Notice: Subject to any disclaimer, the term of this patent is extended or adjusted under 35 U.S.C. 154(b) by 0 days.

(21) Appl. No.: 19/003,179

(22) Filed: Dec. 27, 2024

(30) Foreign Application Priority Data

Jan. 31, 2024 (JP) ..... 2024-012938

(51) Int. Cl.
*F24C 7/08* (2006.01)
*F24C 7/02* (2006.01)

(52) U.S. Cl.
CPC ..... *F24C 7/086* (2013.01); *F24C 7/02* (2013.01)

(58) Field of Classification Search
CPC ..... F24C 7/086; F24C 7/02
See application file for complete search history.

(56) References Cited

U.S. PATENT DOCUMENTS

2003/0168447 A1* 9/2003 Lee ..... H05B 6/6414 219/722
2023/0151970 A1* 5/2023 Ertl ..... F24C 7/086 345/173

FOREIGN PATENT DOCUMENTS

JP 2001263673 A * 9/2001

* cited by examiner

*Primary Examiner* — Robert J Michaud
(74) *Attorney, Agent, or Firm* — ScienBiziP, P.C.

(57) ABSTRACT

A heating cooker includes: a plate having a transparent portion; a display unit including a display; and a position defining portion that is fixed to the plate and configured to define a position of the display unit by positioning the display with respect to the transparent portion.

6 Claims, 10 Drawing Sheets

HEATING COOKER

CROSS-REFERENCE TO RELATED APPLICATION

The present application claims priority from Japanese Application JP2024-012938, the content of which is hereby incorporated by reference into this application.

BACKGROUND OF THE INVENTION

1. Technical Field

The present disclosure relates to a heating cooker.

2. Description of the Related Art

The heating cooker of JP 2001-263673 A includes a control plate, a liquid crystal display element, an electric board, and an installation table. The control plate has a transparent display window. The liquid crystal display element corresponding to the display is disposed at a position facing the display window.

SUMMARY OF THE INVENTION

In JP 2001-263673 A, a liquid crystal display element and an electric board are supported on an installation table. The installation table is assembled to the control plate. In a case where the liquid crystal display element is attached to the display window, a positional deviation error of the liquid crystal display element with respect to the display window and an assembly error of the liquid crystal display element with respect to the installation table exist between the liquid crystal display element and the display window. That is, when the liquid crystal display element is designed, it is necessary to set a dimension in which a margin in consideration of the positional deviation error and the assembly error is estimated in advance. Therefore, in order to dispose the liquid crystal display element at the position of the display window determined in advance by design, it is necessary to use the liquid crystal display element larger than the display window by the margin.

In view of the above problems, an object of the present disclosure is to provide a heating cooker capable of downsizing a display.

A heating cooker according to the present disclosure includes a plate, a display unit, and a position defining portion. The plate includes a transparent portion. The display unit includes a display. The position defining portion is fixed to the plate, and defines a position of the display unit by positioning the display with respect to the transparent portion.

According to the present disclosure, the display can be downsized.

DETAILED DESCRIPTION

Figure 1:
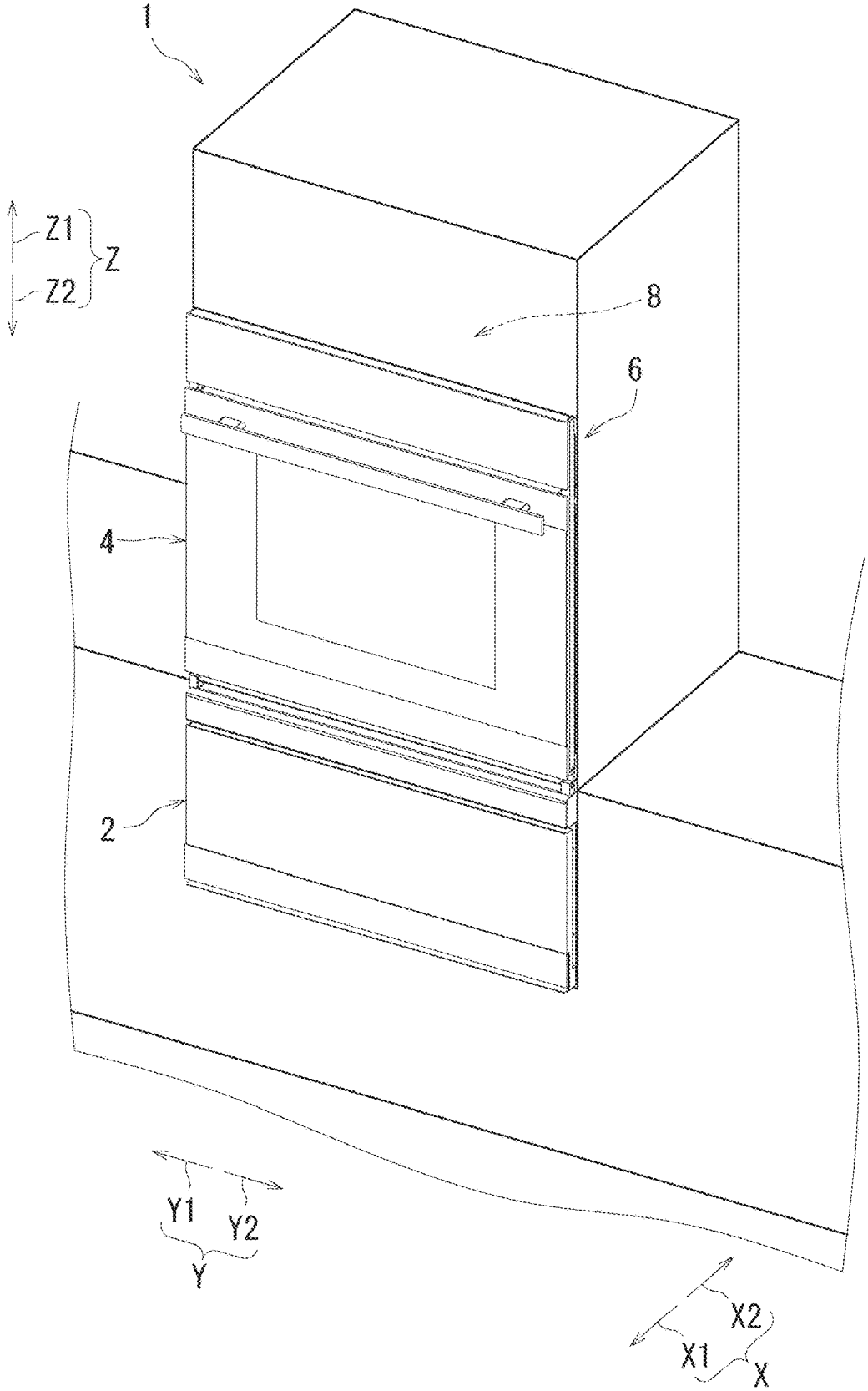
FIG. 1 is an external perspective view illustrating a heating cooker according to the present embodiment.

Hereinafter, an embodiment of the present disclosure will be described with reference to the drawings. Note that, in the drawings, the same or corresponding portions are denoted by the same reference numerals, and descriptions thereof will not be repeated.

Figure 2:
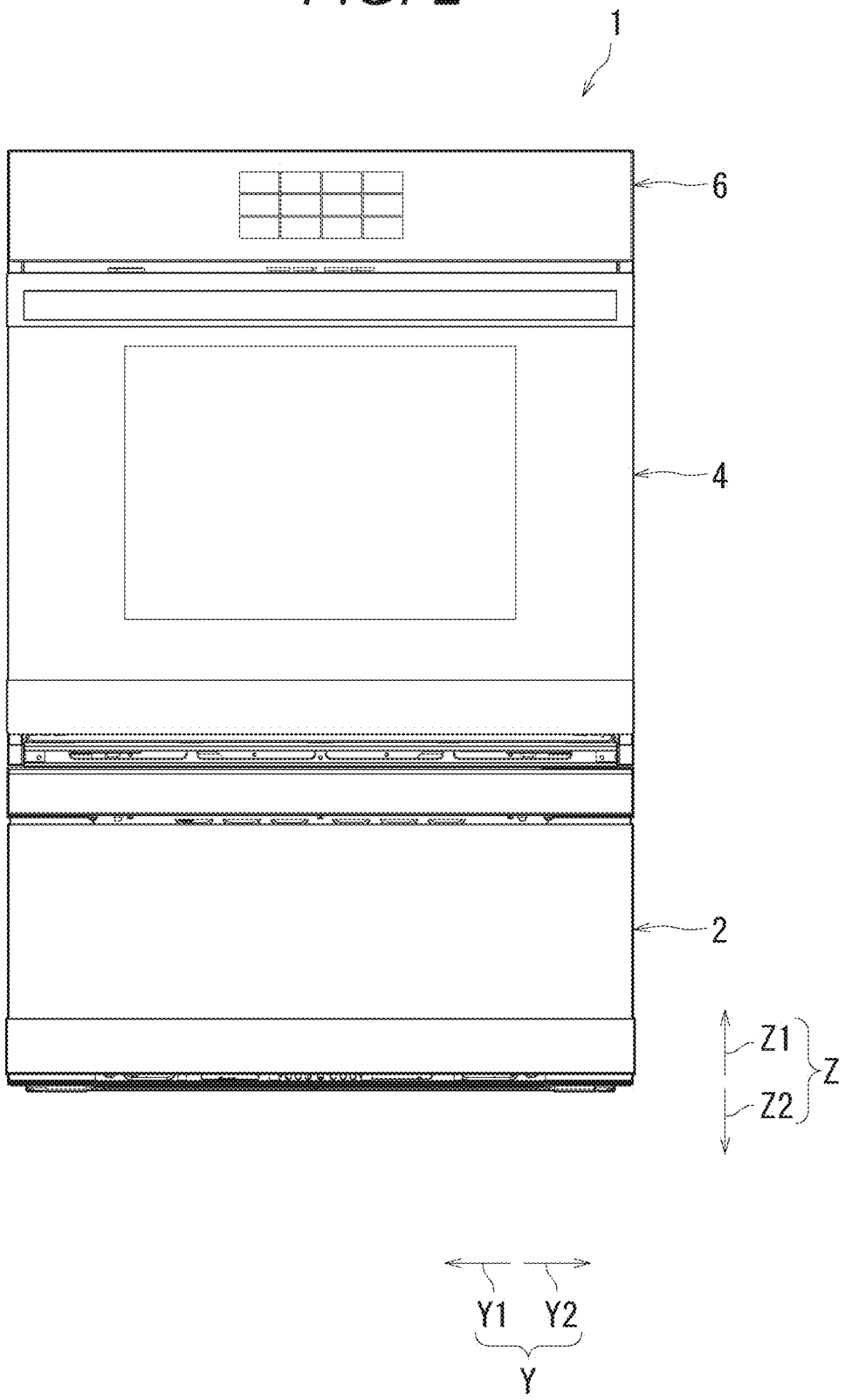
FIG. 2 is a front view illustrating the heating cooker according to the present embodiment.

A heating cooker 1 will be described with reference to FIGS. 1 and 2. FIG. 1 is an external perspective view illustrating the heating cooker 1 according to the present embodiment. Specifically, the drawing illustrates an appearance of the heating cooker 1 as viewed from the upper side diagonally in front of the right. FIG. 2 is a front view illustrating the heating cooker 1 according to the present embodiment. The heating cooker 1 is, for example, a built-in type in which the part of the heating cooker 1 is embedded in a part of a wall. As illustrated in FIGS. 1 and 2, the heating cooker 1 according to the present embodiment includes a first cooker 2, a second cooker 4, a display device 6, and a control device 8.

In the present embodiment, the side of the heating cooker 1 on which the display device 6 is disposed is defined as a front side X1, and the opposite side is defined as a rear side X2. The left side of the heating cooker 1 as viewed from the front side X1 is defined as a left side Y1, and the opposite side is defined as a right side Y2. In addition, in an up-down direction Z orthogonal to a front-rear direction X and a left-right direction Y of the heating cooker 1, a side on which the display device 6 is disposed is defined as an upper side Z1, and an opposite side is defined as a lower side Z2.

The first cooker 2 is, for example, a microwave oven. In the present embodiment, the first cooker 2 has, for example, a microwave heating mode and a grill heating mode as heating cooking modes. The microwave heating mode is a mode for heating and cooking an object to be heated mainly by emitting microwaves into a heating cooking chamber. The grill heating mode is a mode for heating and cooking an object to be heated mainly by radiant heating.

The second cooker 4 is, for example, an oven. The second cooker 4 is disposed on the upper side Z1 with respect to the first cooker 2.

The single display device 6 is, for example, a liquid crystal display (LCD). The display device 6 is a common display device of the first cooker 2 and the second cooker 4.

The control device 8 controls display on the display device 6.

Specifically, the control device 8 includes a processor such as a central processing unit (CPU). The processor controls operations of the heating cooker 1 and the single display device 6 by executing a computer program stored in a storage device (not shown). Specifically, the control device 8 can be realized by an application specific integrated circuit (ASIC) or the like.

The display device 6 is disposed on the upper side Z1 with respect to the second cooker 4, and can receive both a first operation on the first cooker 2 and a second operation on the second cooker 4. The display device 6 displays a selection screen, an operation screen, and an indicator.

The first operation is a selection instruction operation for selecting the first cooker 2, a selection instruction for a cooking method of the first cooker 2, or a selection instruction for a cooking menu.

The second operation is a selection instruction operation for selecting the second cooker 4, a selection instruction for a cooking method of the second cooker 4, or a selection instruction for a cooking menu.

According to the heating cooker 1 of the present disclosure, even when the first cooker 2 and the second cooker 4 are disposed along the up-down direction Z, the first cooker 2 and the second cooker 4 can be easily operated by the single display device 6.

Figure 3:
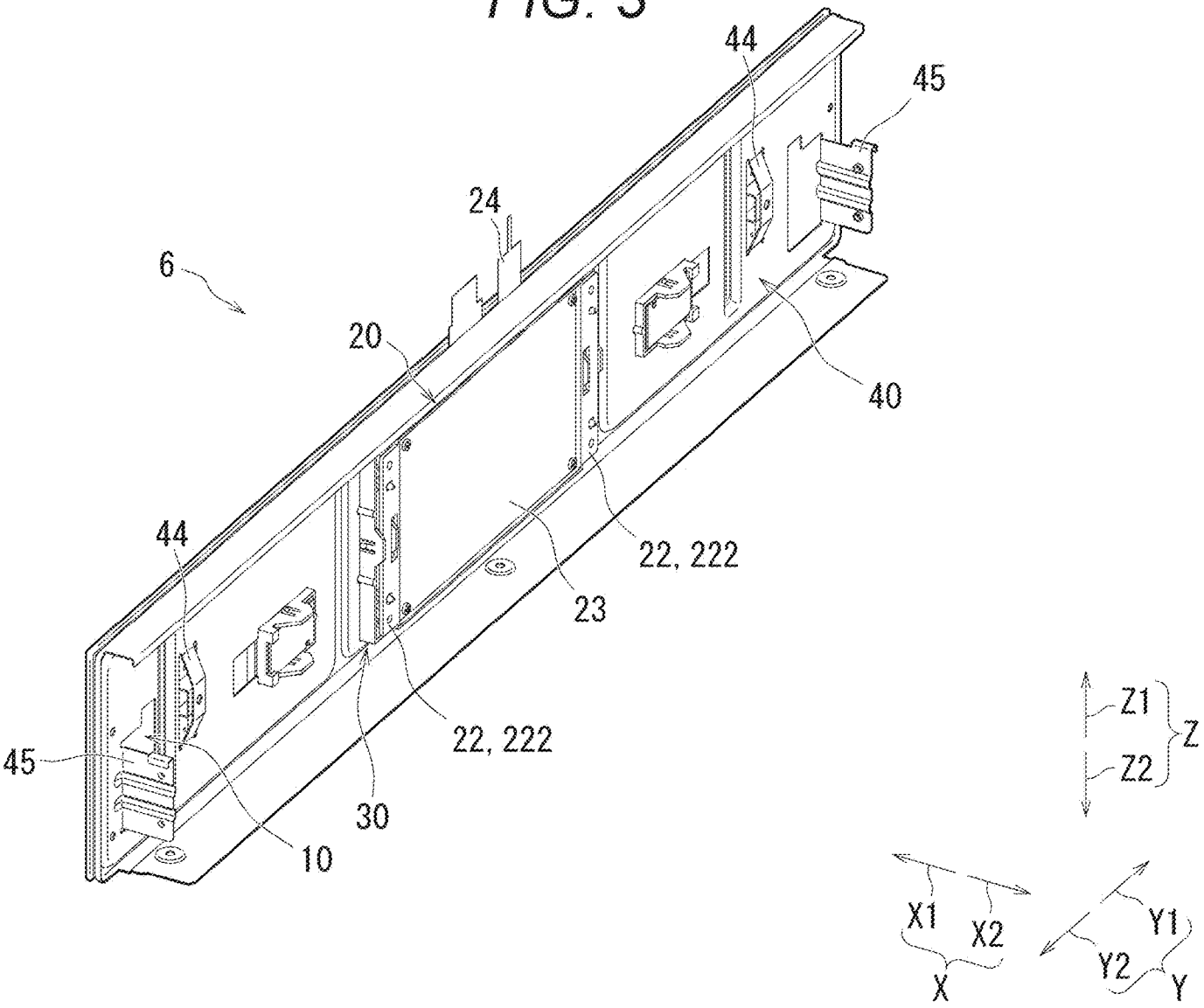
FIG. 3 is a rear perspective view illustrating a display device according to the present embodiment.
Figure 4:
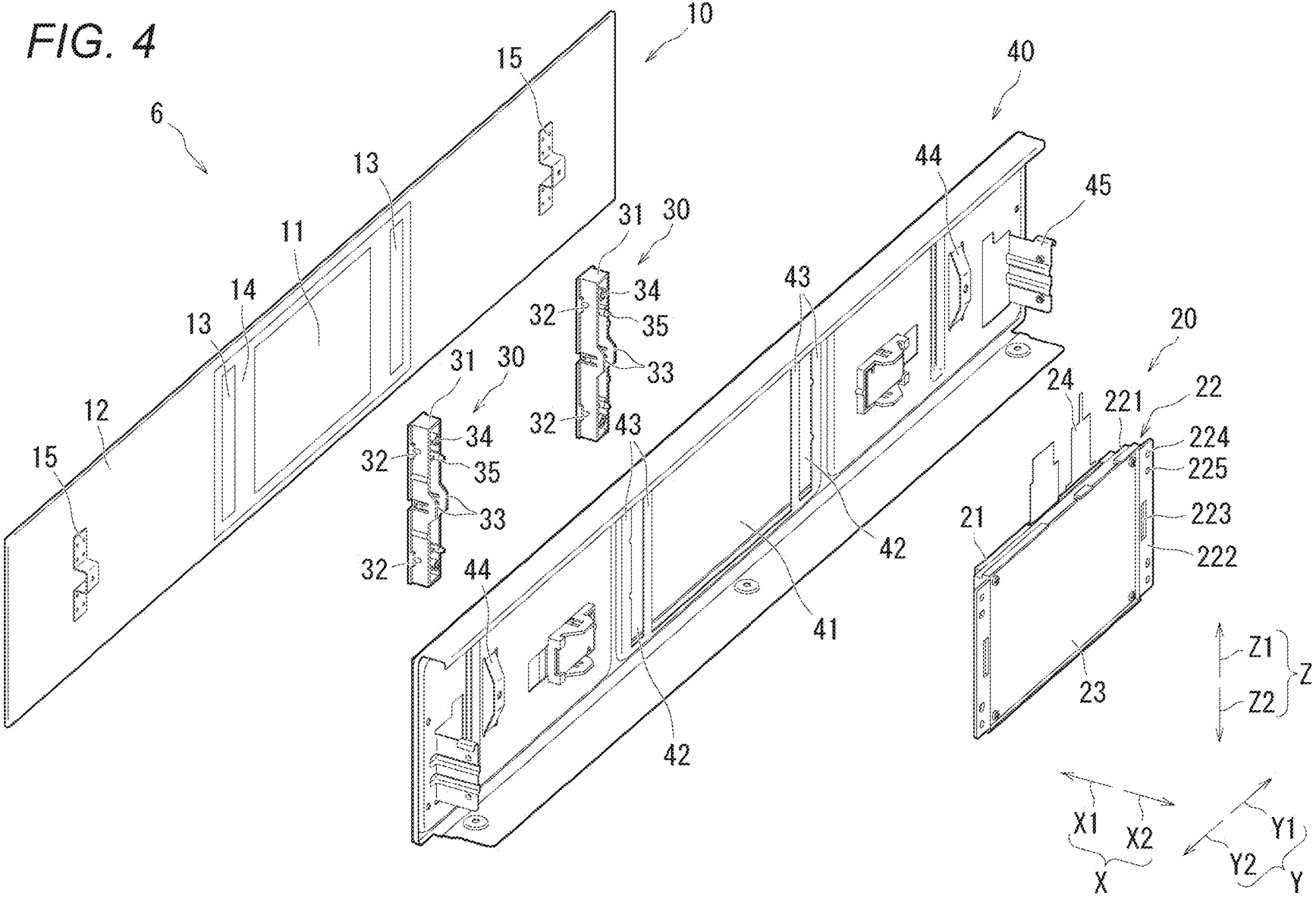
FIG. 4 is an exploded perspective view illustrating the display device according to the present embodiment.
Figure 5:
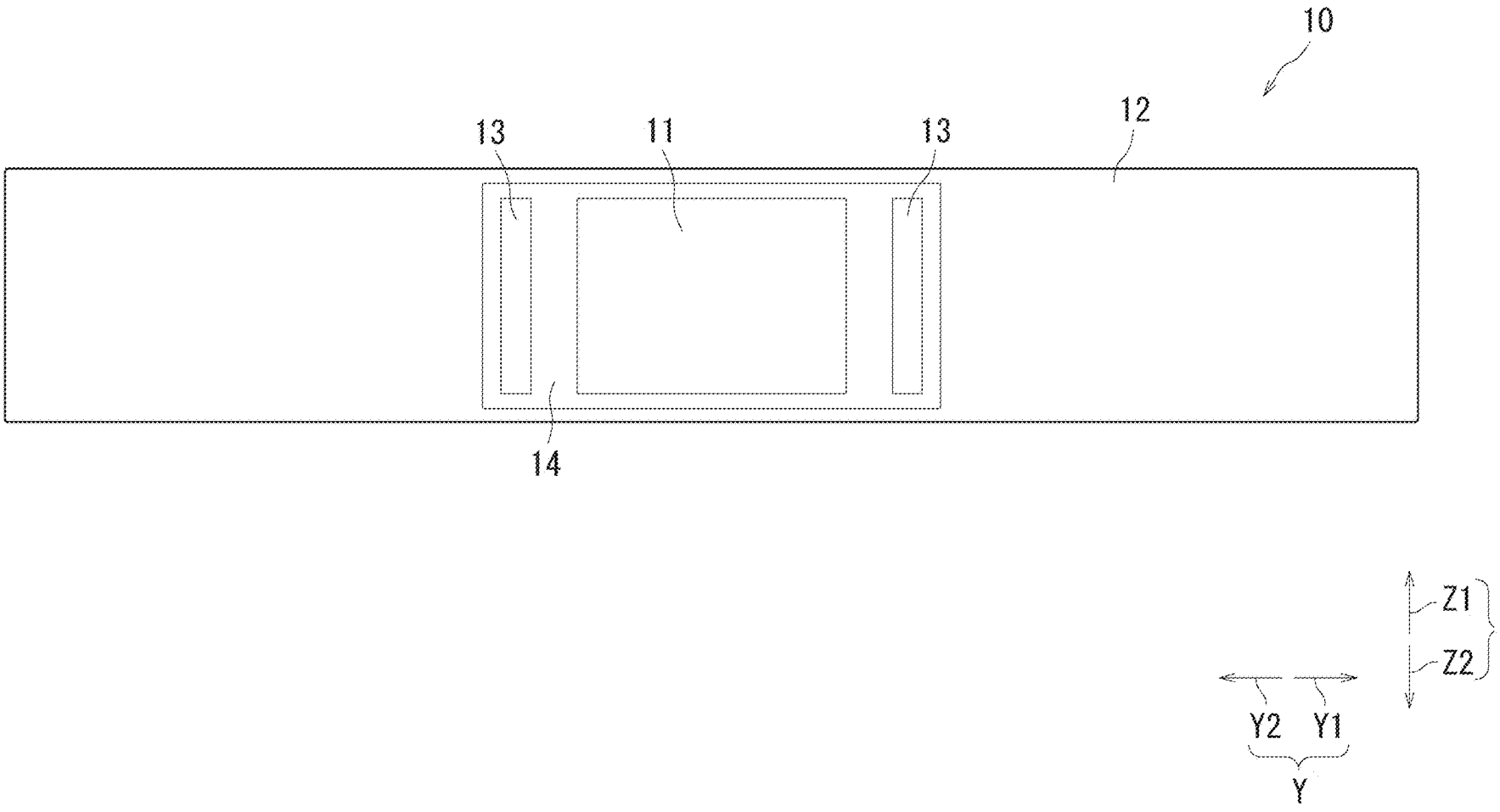
FIG. 5 is a front view illustrating a plate according to the present embodiment.

The display device 6 will be described in detail with reference to FIGS. 3 to 5. FIG. 3 is a rear perspective view illustrating the display device 6 according to the present embodiment. Specifically, FIG. 3 illustrates an appearance of the display device 6 as viewed from the upper side diagonally behind the right. FIG. 4 is an exploded perspective view illustrating the display device 6 according to the present embodiment. FIG. 5 is a front view illustrating a plate 10 according to the present embodiment. For convenience of description, directions in FIGS. 5 to 9 are set based on a state in which the display device 6 is assembled to the heating cooker 1.

As illustrated in FIGS. 3 and 4, the display device 6 includes the plate 10, a display unit 20, and position defining portions 30.

The plate 10 transmits an image. The plate 10 is formed in a rectangular plate shape and covers the front side X1 of the display unit 20. As shown in FIGS. 4 and 5, the plate 10 includes a transparent portion 11, a first colored portion 12, and a second colored portion 14. The plate 10 is made of, for example, glass, but is not limited thereto. The plate 10 only needs to transmit at least an image, and may be made of a synthetic resin material.

The transparent portion 11 is a colorless transparent region. The transparent portion 11 transmits an image displayed by the display unit 20. The transparent portion 11 is formed in a rectangular shape. The transparent portion 11 is disposed in an intermediate region of the plate 10 in the left-right direction Y and the up-down direction Z.

The first colored portion 12 is a colored region. The first colored portion 12 is the entire back surface of the plate 10 excluding the transparent portion 11. In other words, the first colored portion 12 indicates the position of the transparent portion 11. The first colored portion 12 is colored by printing, for example. The first colored portion 12 is, for example, black, but is not limited thereto. The first colored portion 12 may have a dark color other than black. The coloring of the colored portion is not limited to printing. The coloring of the colored portion may be colored by coating.

The second colored portion 14 is a colored region. Regions 13 indicate predetermined positions. This predetermined position is a position where the position defining portion 30 is disposed. The regions 13 are formed in a rectangular shape. The regions 13 are disposed at positions spaced apart from the transparent portion 11 in the left-right direction Y corresponding to the position defining portions 30. Specifically, the left region 13 is separated from the left end portion of the transparent portion 11 by a predetermined distance, and the right region 13 is separated from the right end portion of the transparent portion 11 by a predetermined distance. The second colored portion 14 is colored on the back surface of the first colored portion 12 by, for example, printing. In the present embodiment, in the peripheral region of the transparent portion 11, the second colored portion 14 is printed on the first colored portion 12 except for the region 13. That is, in the region 13, the first colored portion 12 is visually recognized from between the second colored portions 14. As a result, since the boundary of the region 13 becomes clear, the visually recognizability of the region 13 is improved. For example, when there is a difference in brightness between the colors of the first colored portion 12 and the second colored portion 14, the visibility is further improved.

The display unit 20 displays an image. The display unit 20 is formed in a rectangular plate shape and is disposed on the rear side X2 of the plate 10. Specifically, the display unit 20 is disposed behind X2 of the transparent portion 11. As illustrated in FIG. 4, the display unit 20 includes a display 21, a support portion 22, and a board 23.

The display 21 displays an image. The display 21 is located on the rear side X2 of the transparent portion 11. Specifically, the display 21 is formed in a rectangular shape larger outside than the transparent portion 11 in front view. In the display 21, for example, a plurality of pixels is arranged in a matrix. Each pixel is actively matrix driven. In the active matrix drive, several thin film transistors (TFTs) are switching elements of respective pixels. The display 21 includes a transparent insulating first board, a transparent insulating second board facing the first board, and a liquid crystal layer interposed between the first board and the second board (none of which are illustrated).

The support portion 22 supports the display 21 and the board 23. As illustrated in FIG. 4, the support portion 22 includes a support main body 221 and projecting portions 222. The support main body 221 and the projecting portions 222 are formed of, for example, a synthetic resin into a single member.

The support main body 221 supports the display 21 on the front side X1. The support main body 221 supports the board 23 on the rear side X2. The support main body 221 is larger than the display 21 and has a rectangular shape in front view. Note that the support main body 221 is not limited to be larger than the display 21 and have a rectangular shape. The support main body 221 may be smaller than the display 21.

The projecting portion 222 holds the support main body 221 in the position defining portion 30. The projecting portions 222 are provided, for example, on both left and right sides of the support main body 221, respectively. When the display unit 20 is disposed at the set location of the plate 10, the pair of left and right projecting portions 222 is located on the rear side X2 of the pair of left and right regions 13.

The board 23 controls display on the display 21. As illustrated in FIG. 4, the board 23 includes a control board, a driver board (none of which are illustrated), and a signal line 24. The control board controls the display 21. The driver board drives the display 21. The signal line 24 connects the control board and the driver board.

The position defining portions 30 define a position of the display unit 20. The position defining portions 30 are fixed to the plate 10. The position defining portions 30 position the display 21 with respect to the transparent portion 11. Thus, according to the display device 6, the display 21 can be downsized. That is, the display 21 is fixed to the plate 10 via the position defining portions 30. The display that is not fixed to the plate has a positional deviation error and an assembly error. Therefore, the display 21 fixed to the plate 10 via the position defining portions 30 can suppress the positional deviation amount with respect to the transparent portion 11 as compared with the display not fixed to the plate 10. Therefore, it is possible to suppress the margin considering the positional deviation amount, and the size of the display 21 can be made smaller than that of the display not fixed to the plate 10.

As illustrated in FIGS. 4 and 5, the first colored portion 12 indicates the position of the display 21. The second colored portion 14 indicates the position of the position defining portion 30. Thus, according to the display device 6, the display 21 can be further downsized. Since the attachment positions of the position defining portions 30 become clear, the work accuracy at the time of attachment of the position defining portions 30 is improved. As a result, the attachment accuracy of the display unit 20 to the plate 10 can be improved, and the margin of the display 21 can be reduced.

Figure 6:
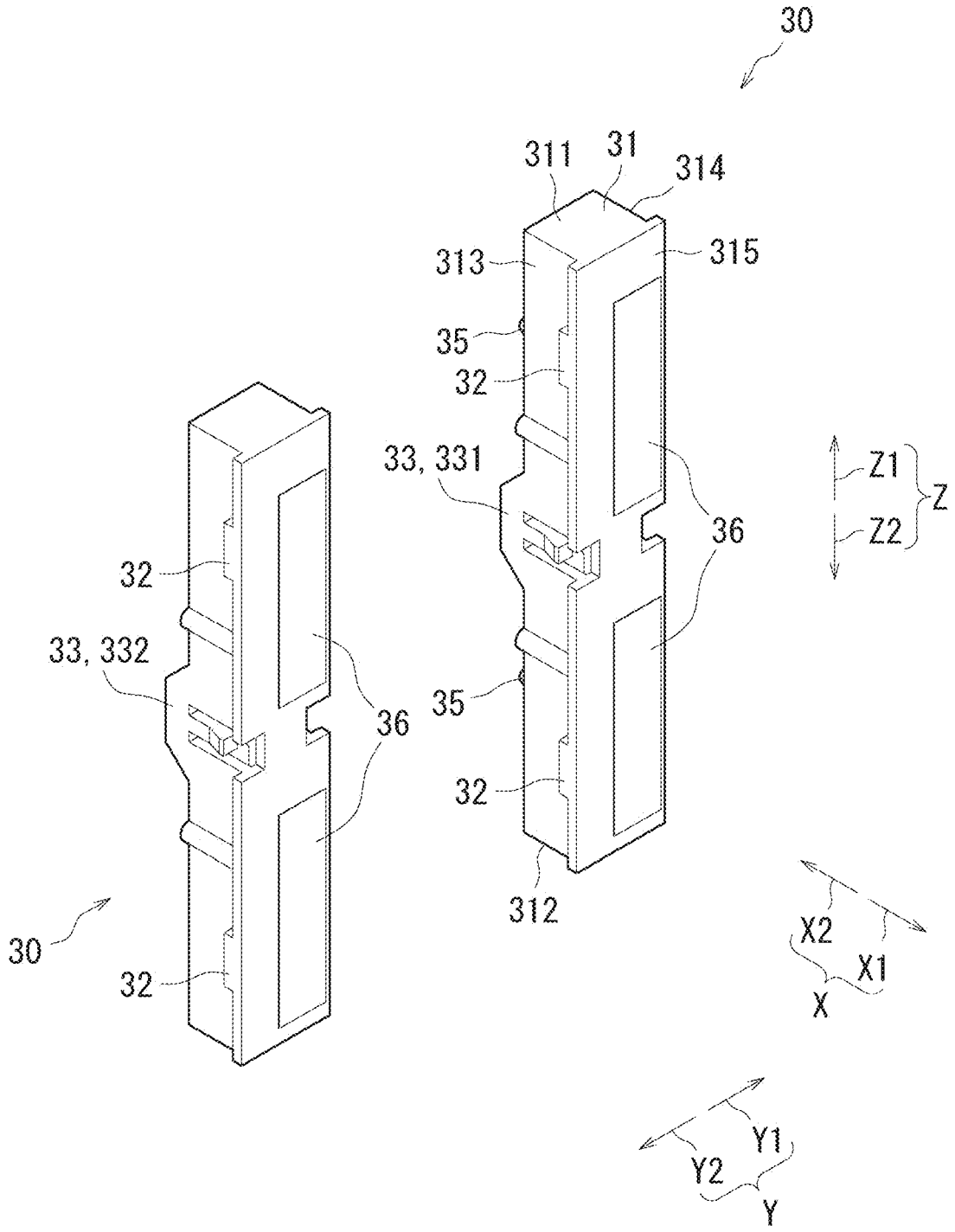
FIG. 6 is a perspective view illustrating a position defining portion according to the present embodiment.
Figure 7:
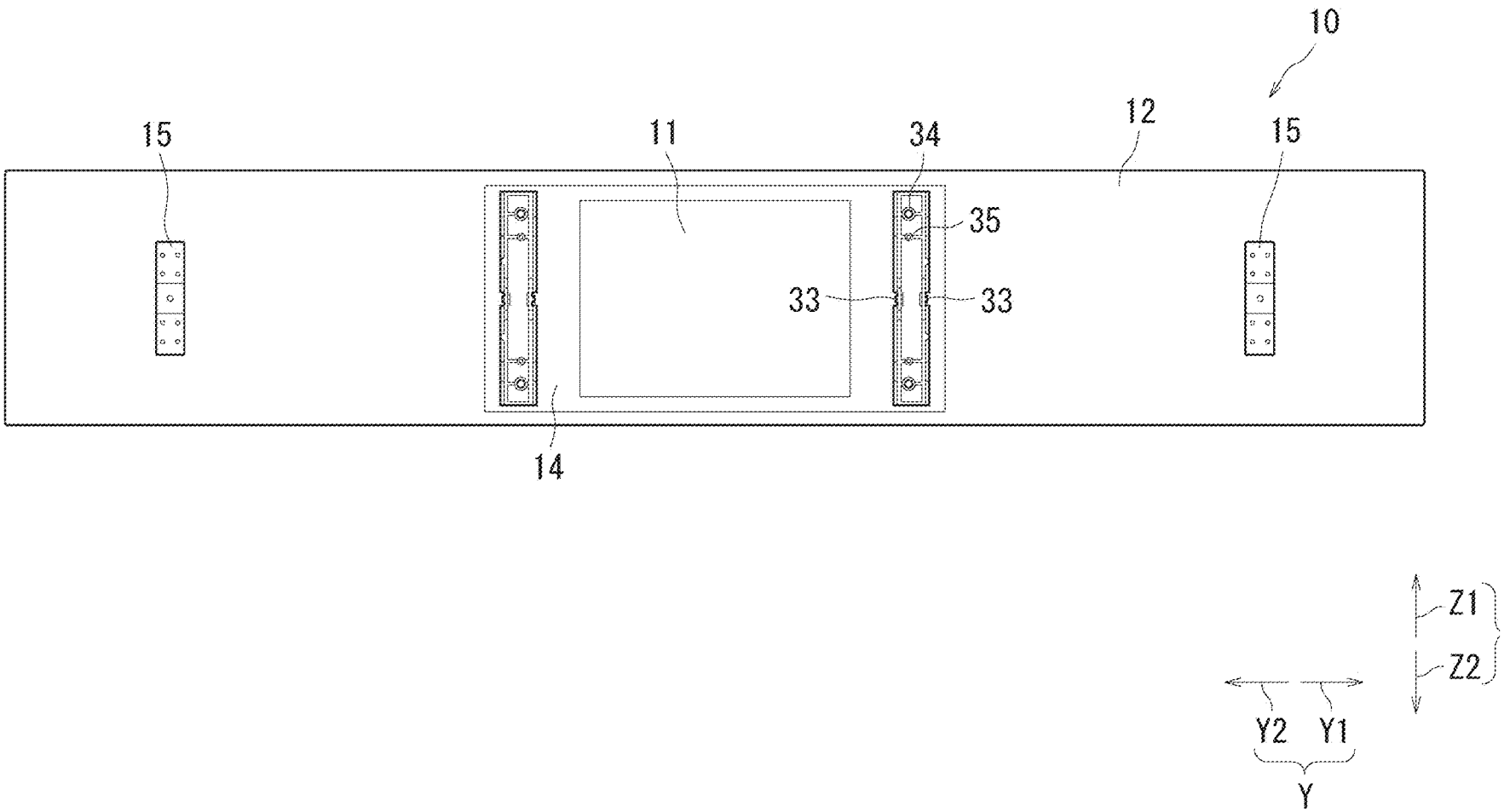
FIG. 7 is a view illustrating a state in which the position defining portion is disposed on a plate.
Figure 8:
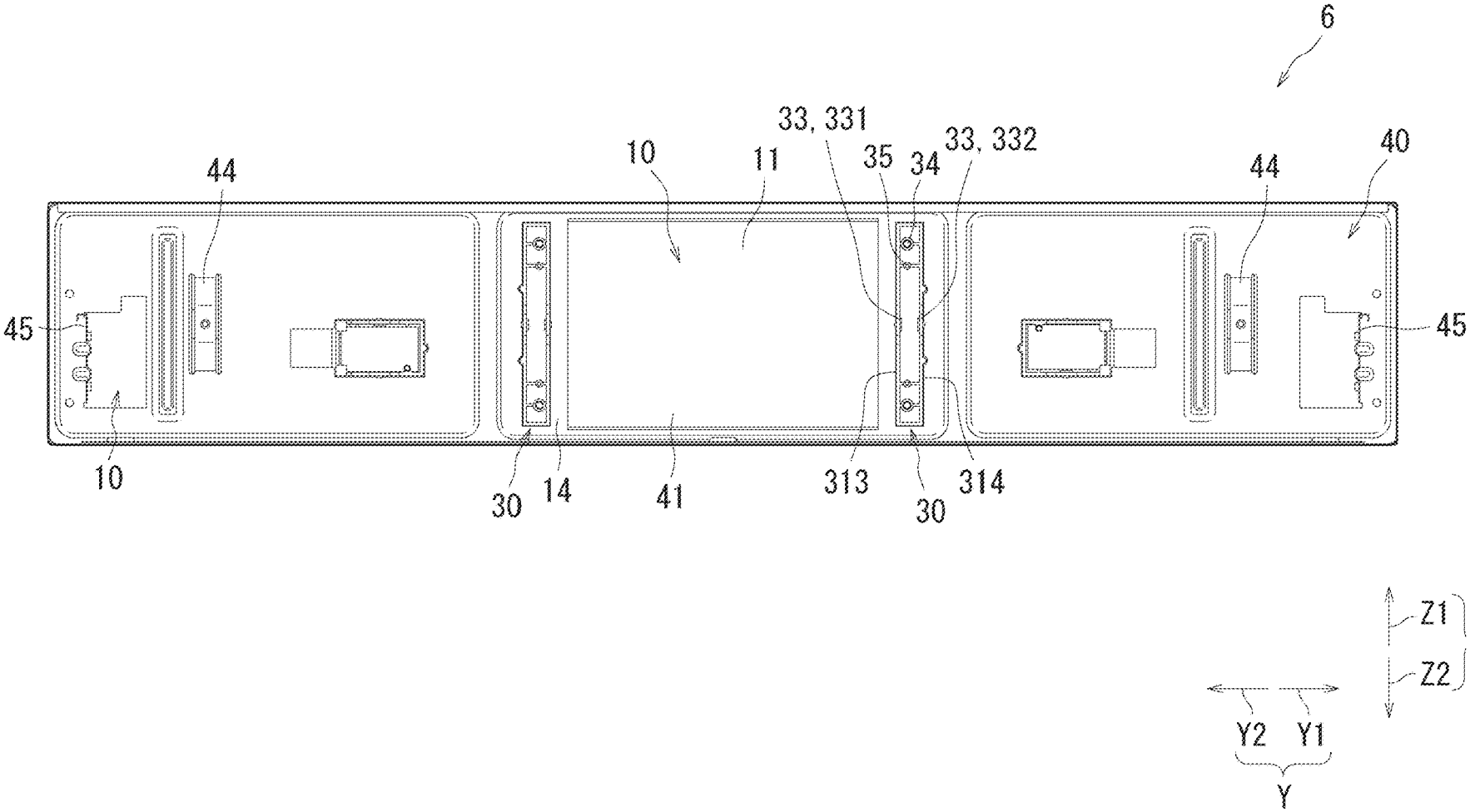
FIG. 8 is a view illustrating a state in which a base is disposed on a plate.
Figure 9:
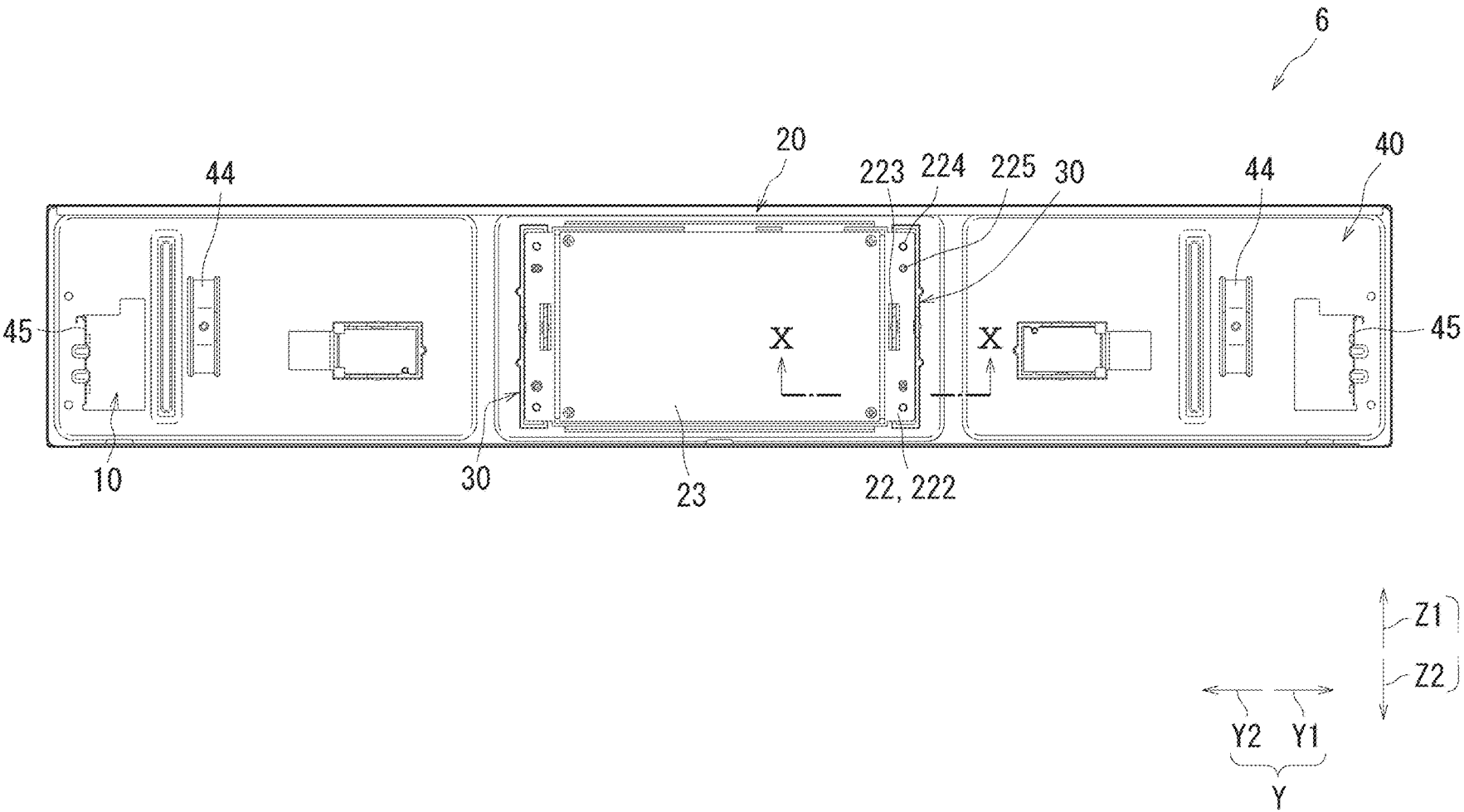
FIG. 9 is a view illustrating a state in which the display unit is disposed on the position defining portions.
Figure 10:
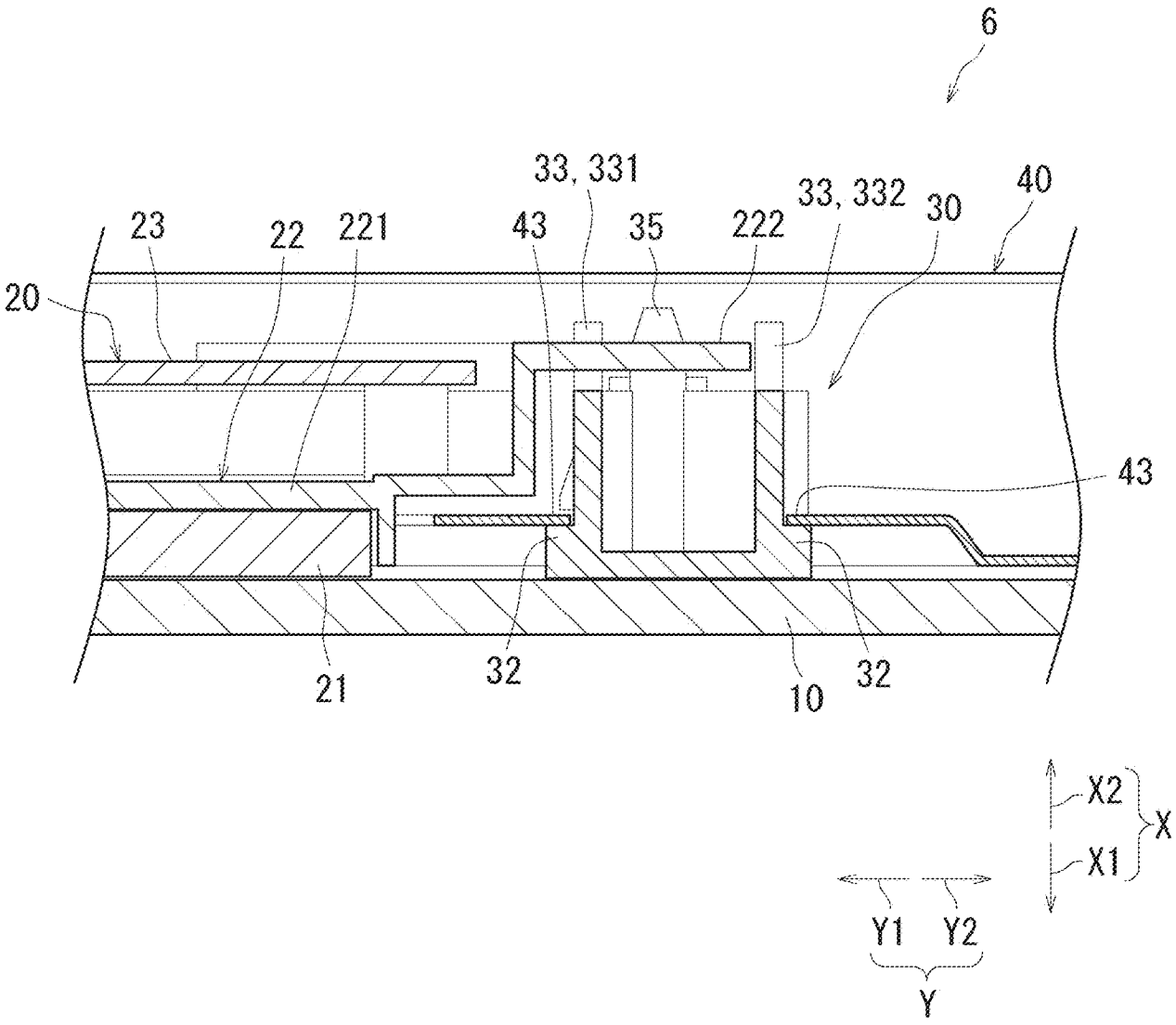
FIG. 10 is a cross-sectional view along line X-X in FIG. 9.

The display device 6 will be described in more detail with reference to FIGS. 6 to 10. FIG. 6 is a perspective view illustrating the position defining portions 30 according to the present embodiment. FIG. 7 is a view illustrating a state in which the position defining portions 30 are disposed on the plate 10. FIG. 8 is a view illustrating a state in which a base 40 is disposed on the plate 10. FIG. 9 is a view illustrating a state in which the display unit 20 is disposed on the position defining portions 30. FIG. 10 is a cross-sectional view along line X-X in FIG. 9.

As illustrated in FIGS. 6 to 8, the position defining portion 30 includes a main body 31, protrusions 32, protruding portions 33, boss portions 34, and pin portions 35.

The main body 31 is made of a synthetic resin material and has a rectangular parallelepiped shape. The main body 31 includes an upper portion 311, a lower portion 312, an inner portion 313, an outer portion 314, and a front portion 315. The inner portion 313 is a side portion close to the transparent portion 11, and the outer portion 314 is a side portion far from the transparent portion 11. The main body 31 corresponds to, for example, a "position defining main body".

The front portion 315 has substantially the same shape as the region 13 in front view. The front portion 315 overlaps the region 13. As illustrated in FIG. 6, for example, a double-sided tape 36 is attached to the front surface of the front portion 315. As illustrated in FIGS. 7 and 8, the front portion 315 is attached to the back surface (rear surface) of the plate 10 so as to overlap the region 13 with the double-sided tape 36 interposed therebetween. The protrusions 32 are partially provided at both left and right end portions of the front portion 315. The protrusions 32 protrude to the rear side X2 from the rear surface of the front portion 315 at intermediate portions in the up-down direction Z.

As illustrated in FIG. 8, the protruding portions 33 are provided on the inner portion 313 and the outer portion 314. Specifically, the inner protruding portion 331 extends toward the rear side X2 at an intermediate portion of the inner portion 313 in the up-down direction Z. The outer protruding portion 332 extends toward the rear side X2 at an intermediate portion of the outer portion 314. In other words, the protruding portion 33 protrudes in a direction opposite to the plate 10. The pair of protruding portions 33 is separated by a predetermined distance in the left-right direction Y.

For example, a pair of upper and lower pin portions 35 is provided between the inner portion 313 and the outer portion 314 with the protruding portions 33 interposed therebetween. The pair of pin portions 35 extends from the front portion 315 toward the rear side X2. The end portion of the pin portion 35 on the rear side X2 is located on the rear side X2 with respect to the end portion of the boss portion 34 on the rear side X2. The rear end of the pin portion 35 is tapered.

For example, a pair of upper and lower boss portions 34 is provided between the inner portion 313 and the outer portion 314 with the protruding portions 33 and the pin portions 35 interposed therebetween. The pair of boss portions 34 extends from the front portion 315 toward the rear side X2.

As illustrated in FIG. 9, the projecting portions 222 project outward from the support main body 221 beyond the display 21 (see FIG. 4). The display unit 20 is held by the position defining portions 30 via the projecting portions 222. Consequently, the display unit 20 can be held by the position defining portions 30 with a simple configuration.

As illustrated in FIGS. 4 and 9, the projecting portion 222 includes a protruding hole 223, boss holes 224, and pin holes 225.

As illustrated in FIG. 9, the inner protruding portion 331 (see FIG. 8) is inserted into the protruding hole 223. The outer protruding portion 332 (see FIG. 8) is located outside the outer end portion of the projecting portion 222. A part of the projecting portion 222 is sandwiched between the inner protruding portion 331 and the outer protruding portion 332. The display unit 20 is supported in a posture in which the protruding portion 331 is inserted into the protruding hole 223. Accordingly, positioning accuracy can be improved. Specifically, since the protruding portion 331 is inserted into the protruding hole 223, it is possible to suppress positional deviation of the display unit 20 in the up-down direction Z and the left-right direction Y.

A pair of upper and lower pin holes 225 is provided with the protruding hole 223 interposed therebetween. The pair of pin portions 35 (see FIG. 4) is respectively inserted into the pair of pin holes 225. The diameter of the pin hole 225 is substantially the same as the diameter of the pin portion 35. Therefore, the pin portions 35 pass through the pin holes 225, whereby the display unit 20 is positioned with respect to the position defining portions 30. Since the rear end of the pin portion 35 is tapered, when the pin portion 35 is inserted, the pin portion 35 is guided in the tapered shape toward the pin hole 225 and finally enters the pin hole 225.

A pair of upper and lower boss holes 224 is provided with the protruding hole 223 and the pin holes 225 interposed therebetween. When the pin portions 35 are inserted into the pin holes 225, the boss portions 34 are positioned on the front side X1 of the boss holes 224. Therefore, the pair of boss portions 34 faces the pair of boss holes 224 in the front-rear direction X.

As illustrated in FIGS. 3 and 4, the display device 6 includes the base 40.

The base 40 sandwiches the position defining portions 30 with the plate 10. The base 40 fixes the position defining portions 30. That is, the base 40 is fixed to the plate 10 in a posture in which the position defining portions 30 are sandwiched between the base 40 and the plate 10. As a result, positional deviation of the display 21 with respect to the transparent portion 11 can be suppressed. Specifically, attaching the base 40 to the plate 10 also serves to fix the position defining portions 30 to the plate 10. The base 40 attaches the display unit 20 and the like to the second cooker 4. The base 40 sandwiches the position defining portions 30 with the plate 10. The base 40 includes a first opening 41, second openings 42, pressing portions 43, assembly brackets 44, and attachment brackets 45.

As illustrated in FIGS. 4 and 8, in a state where the pair of position defining portions 30 is attached to the plate 10, the first opening 41 is formed from the inner portion 313 (see FIG. 6) of one position defining portion 30 to the inner portion 313 of the other position defining portion 30. Specifically, the first opening 41 is provided substantially corresponding to the display 21.

As illustrated in FIG. 4, a pair of left and right second openings 42 is provided. In a state where the pair of position defining portions 30 is attached to the plate 10, the pair of position defining portions 30 is inserted through the pair of second openings 42. Note that a pair of assembly brackets 15 is attached to both left and right sides of the plate 10. The assembly bracket 15 is provided with a screw hole to be fastened by a screw (not illustrated).

As illustrated in FIG. 10, the pressing portion 43 is disposed on each of the left side and the right side of the position defining portion 30. Specifically, the pressing portion 43 is in contact with the rear surface of the protrusion 32. As illustrated in FIG. 8, after the base 40 is disposed on the back surface of the plate 10, the assembly brackets 15 and the assembly brackets 44 are fastened via screws. As a result, the plate 10 and the base 40 are brought into close contact with each other, and the pressing portions 43 press the protrusions 32 toward the plate 10.

The display device 6 is configured by assembling the position defining portions 30 and the base 40 to the plate 10 and assembling the display unit 20 to the position defining portions 30. The display device 6 is attached to a housing of the heating cooker 1 via the attachment brackets 45.

The embodiment of the present disclosure has been described above with reference to the drawings. However, the present disclosure is not limited to the above embodiment, and can be implemented in various aspects without departing from the gist thereof. For easy understanding, the drawings may schematically illustrate each component mainly. The number and the like of each illustrated component may be different from the actual number and the like for convenience of drawing creation. In addition, each component shown in the above embodiment is an example, and is not particularly limited, and various modifications can be made without substantially departing from the effect of the present disclosure.

(1) In the present embodiment, the heating cooker 1 includes the first cooker 2 and the second cooker 4. The display device 6 displays information of the first cooker 2 and the second cooker 4, but the present disclosure is not limited thereto. The heating cooker 1 may be configured by a single cooker. In this case, the display device 6 displays information of the single cooker.

(2) In the present embodiment, the heating cooker 1 includes the first cooker 2 and the second cooker 4. The display device 6 displays information of the first cooker 2 and the second cooker 4 on the single display 21, but the present disclosure is not limited thereto. The display device 6 may include a display that exclusively displays information of the first cooker 2 and a display that exclusively displays information of the second cooker 4. In this case, the position defining portion 30 may be provided corresponding to each display, or the position defining portion 30 may be provided in common for each display.

(3) In the present embodiment, the position defining portion 30 includes a boss portion 34 and a pin portion 35. The projecting portion 222 of the display unit 20 has the boss hole 224 and the pin hole 225, but the present disclosure is not limited thereto. The longitudinal length of the boss portion 34 may be increased, and the boss portion 34 and the boss hole 224 may be connectable. When the boss portion 34 passes through the boss hole 224 having substantially the same diameter, the display unit 20 is positioned with respect to the position defining portion 30. Therefore, by providing the boss portion 34 with a function of a positioning pin, the pin portion 35 and the pin hole 225 can be omitted.

(4) In the present embodiment, the plate 10 is configured using glass as a material, but the present disclosure is not limited thereto. The plate 10 may be made of an acrylic resin or may be made of polycarbonate.

(5) In the present embodiment, the first cooker 2 has the microwave heating mode and the grill heating mode as the heating cooking mode, but the present disclosure is not limited thereto. The first cooker 2 may have only the microwave heating mode as the heating cooking mode, or may have another heating mode other than the microwave heating mode and the grill heating mode.

The present disclosure is applicable to the field of heating cookers.

What is claimed is:

1. A heating cooker comprising:

a plate including a transparent portion;

a display unit including a display; and a position defining portion that is directly fixed to both the plate and the display unit, wherein the position defining portion is fixed to a position on the plate and configured to define a position of the display unit by positioning the display with respect to the transparent portion.

2. The heating cooker according to claim 1, wherein the plate further includes:

a first colored portion indicating a position of the display, and a second colored portion indicating a position of the position defining portion.

3. The heating cooker according to claim 1, wherein the display unit further includes a support portion configured to support the display, wherein the support portion includes:

a support main body, and a projecting portion that projects outward from the display and the support main body, and wherein the display unit is held by the position defining portion via the projecting portion.

4. The heating cooker according to claim 3, wherein the position defining portion includes:

a position defining main body, and a protruding portion protruding from the position defining main body in a direction opposite the plate, wherein the projecting portion has a hole through which the protruding portion is insertable, and wherein the display unit is supported in a posture in which the protruding portion is inserted into the hole.

5. The heating cooker according to claim 1, further comprising a base fixed to the plate in a posture in which the position defining portion is sandwiched between the base and the plate.

6. The heating cooker according to claim 1, wherein the position defining portion, that is fixed to the position on the plate and the position is separated from another position where the display unit is located, is configured to define the position of the display unit by positioning the display with respect to the transparent portion.

* * * * *